US010040109B2

(12) United States Patent
Bruhnke

(10) Patent No.: US 10,040,109 B2
(45) Date of Patent: Aug. 7, 2018

(54) METHOD AND APPARATUS FOR PRODUCING METAL SHEETS FROM STRAND-SHAPED PROFILES

(71) Applicant: Ulrich Bruhnke, Ehningen (DE)

(72) Inventor: Ulrich Bruhnke, Ehningen (DE)

( * ) Notice: Subject to any disclaimer, the term of this patent is extended or adjusted under 35 U.S.C. 154(b) by 251 days.

(21) Appl. No.: 14/784,060

(22) PCT Filed: Apr. 8, 2014

(86) PCT No.: PCT/DE2014/000179
§ 371 (c)(1),
(2) Date: Oct. 13, 2015

(87) PCT Pub. No.: WO2014/166474
PCT Pub. Date: Oct. 16, 2014

(65) Prior Publication Data

US 2016/0059289 A1 Mar. 3, 2016

(30) Foreign Application Priority Data

Apr. 10, 2013 (DE) ..... 10 2013 006 171

(51) Int. Cl.

| | |
|---|---|
| ***B21C 23/00*** | (2006.01) |
| ***B21C 23/06*** | (2006.01) |
| ***B21C 37/02*** | (2006.01) |
| ***C22C 23/00*** | (2006.01) |

(52) U.S. Cl.
CPC ..... *B21C 23/00* (2013.01); *B21C 23/06* (2013.01); *B21C 37/02* (2013.01); *C22C 23/00* (2013.01)

(58) Field of Classification Search
CPC ..... B21C 23/00; B21C 23/002; B21C 23/06; B21C 37/02; B21D 26/14
See application file for complete search history.

(56) References Cited

U.S. PATENT DOCUMENTS

| | | | | |
|---|---|---|---|---|
| 3,171,014 | A | 2/1965 | Ducati | |
| 3,212,311 | A * | 10/1965 | Kiyoshi | B21D 26/14 72/364 |
| 5,619,878 | A | 4/1997 | Grosjean et al. | |
| 6,708,542 | B1 * | 3/2004 | Gafri | B21D 26/14 29/419.2 |
| 7,076,981 | B2 * | 7/2006 | Bradley | B21D 26/14 29/419.2 |
| 2005/0194072 | A1 * | 9/2005 | Luo | B21C 23/002 148/557 |

FOREIGN PATENT DOCUMENTS

| | | | |
|---|---|---|---|
| CN | 1681672 | A | 10/2005 |
| CN | 101590501 | A | 12/2009 |
| CN | 102179422 | | 9/2011 |
| CN | 102451869 | A | 5/2012 |
| DE | 3412486 | A1 | 10/1985 |

(Continued)

*Primary Examiner* — Pradeep C Battula
(74) *Attorney, Agent, or Firm* — Smartpat PLC

(57) ABSTRACT

A method for producing metal sheets from strand-shaped profiles having a low thickness made of magnesium or magnesium alloys, wherein an open or a closed extruded profile is produced in a preceding method step, wherein the extruded profile exiting the extrusion die of an extrusion press is shaped to form a planar metal sheet by the contact-less action of electromagnetic forces.

16 Claims, 1 Drawing Sheet

(56) References Cited

FOREIGN PATENT DOCUMENTS

| | | | |
|---|---|---|---|
| DE | 43 33 500 | | 3/1996 |
| DE | 102 47 129 | | 4/2004 |
| DE | 101 50 021 | | 8/2005 |
| DE | 103 17 080 | | 4/2006 |
| DE | 10243726 | | 3/2008 |
| DE | 10 2007 002 322 | | 7/2008 |
| DE | 10 2008 048 576 | | 3/2010 |
| DE | 102008048496 | A1 | 4/2010 |
| DE | 102009039759 | A1 | 3/2011 |
| EP | 3695592 | A1 | 2/1996 |
| JP | 2001150015 | A | 6/2001 |
| JP | 2007296553 | A | 11/2007 |

* cited by examiner

METHOD AND APPARATUS FOR PRODUCING METAL SHEETS FROM STRAND-SHAPED PROFILES

BACKGROUND OF THE INVENTION

The invention relates to a method, and to a system or apparatus for producing metal sheets from strand-shaped profiles having a low thickness (i.e., which are thin) which are produced in particular from magnesium or magnesium alloys, by way of extrusion.

It is generally known to produce metal sheets by way of rolling in conventional roll stands, wherein corresponding material blocks are reworked to form metal sheets by rolling operations so as to produce metal sheets. Due to the large number of reduction passes from the heavy plate to the thin sheet, this method is very cost-intensive. However, processing magnesium blocks to form corresponding metal sheets is very complex, and the inherent brittleness of magnesium often results in cracking. The high number of reduction passes also adversely affects the structural conditions, and thus the mechanical properties.

DE 101 50 021 B4 discloses a method and a device for producing profiles or sheet metal parts from magnesium or magnesium alloys by way of forming under compressive conditions using extrusion, rolling, forging or casting, wherein the liquid melt is introduced into a continuous casting or extrusion unit to produce a semi-finished product, and immediately thereafter this semi-finished product is given the net shape thereof by way of forming in the warm state, wherein the temperature of the material after solidification from the melt is maintained in a range of 250° C. to 350° during the entire manufacturing operation, and the manufacturing process from casting to cooling of the formed parts is carried out as a whole in an inert atmosphere or under vacuum.

The device for carrying out these method steps is characterized in that the system is composed of a chain of a melting furnace, a continuous casting or extrusion unit, with or without roll stand, a cutting unit, one or more presses, and a cooling unit, the collectivity or parts of the aforementioned units being disposed in a protective gas chamber or vacuum chamber.

Moreover a method for producing formed sheet metal parts from magnesium is described in DE 103 17 080 B4, in which a formed sheet metal part can be produced immediately following a rolling process by way of forming using at least one press in a temperature range of >350° C. to 450° C. The device described for carrying out this method, which is composed of a chain of a melting furnace or crucible, a continuous casting unit, one or more roll stands, a cutting unit, one or more presses, and a cooling unit and is operated in a protective gas chamber or vacuum chamber, is characterized in that a stamping unit, which can be used to introduce dimensionally and cross-sectionally stable stamped holes, and/or formed holes, into blanks coming from the cutting device, is provided between the cutting unit and the press designed as a forming press.

DE 102 47 129 A1 describes another method for producing profiles or formed sheet metal parts from magnesium or magnesium alloys, in which a semi-finished product in the form of a metal sheet is given the net shape thereof by way of forming, preferably by way of compression molding, wherein the surface is freed from impurities in a method step immediately prior to the forming operation by way of chip removing, and preferably by way of shaving.

The disadvantage that remains with this method is that it is only possible to produce parts having a limited width, since larger parts require significantly more effort for the working pressures that are to be controlled. The tool and the machine frame must withstand the extrusion pressure that is present during the manufacture of the semi-finished products or the parts, together with a corresponding counter-pressure, and therefore must necessarily be dimensioned considerably larger.

DE 43 33 500 C2 discloses a method for producing a metal sheet that is stepped in the cross-section and has a solid profile and different wall thicknesses, in which first a semi-finished product is produced, the cross-section of which is similar to the cross-section of the metal sheet in the thickness direction, and in which the semi-finished product is roiled to obtain a metal sheet, wherein, for the production of the semi-finished product, a hollow profile having a wall thickness progression that is distributed over the periphery and corresponds to the desired wall thickness progression of the semi-finished product is extruded, and the hollow profile is severed along a peripheral surface line and formed to obtain the semi-finished product. In addition, two complementary profiles are laid one upon the other, wherein at least one of the profiled contact sides of the complementary profiles is provided with a parting agent, and the two complementary profiles are rolled out simultaneously using cylindrical, which is to say non-stepped, rolls. Prior to rolling, the two complementary profiles are severed on two opposing peripheral surface lines.

This method is used to produce two parts, respectively. The manufacturing process is discontinuous, and only relatively narrow parts can be produced. Other disadvantages are that only relatively narrow parts can be fabricated and the fact that the manufacturing process is relatively complex due to the manufacture of the semi-finished product that is implemented with two different wall thicknesses and a stepped roll system.

A method for producing formed sheet metal parts and a device for carrying out the method are known from DE 10 2008 048 A1. The method comprises the steps of—extruding or continuously casting a tubular body,—cutting open the tubular body in the longitudinal direction of the same,—expanding the tubular body to form a planar body, and—finishing the planar body to obtain a component in correspondence with the drawing by way of manufacturing technologies that are known per se. The device is essentially composed of a chain of a melting unit, a continuous casting or extrusion unit, a longitudinal cutting unit, a roll stand, and one or more forming units.

A method for producing metal sheets or sheet metal parts from lightweight metal, preferable magnesium, is known from DE 10 2007 002 322 A1, wherein in one or more preceding method steps an extruded profile having an open structure, or a closed structure with subsequent cutting to form an open structure, is produced, and the same is subsequently subjected in one or more steps to a roller straightening process and a roller bending process across multiple rolling and bending stages.

SUMMARY OF THE INVENTION

It is the object of the invention to provide a method and a system or apparatus for producing metal sheets from strand-shaped profiles have a low thickness, in particular from magnesium or magnesium alloys, wherein the open or closed extruded profiles exiting an extrusion die can be continuously formed to obtain a planar metal sheet.

According to the invention, this object is achieved by shaping the extruded profile exiting the extrusion die of an extrusion press to form a planar metal sheet by the contactless action of electromagnetic forces and then subjecting the metal sheet to a smoothing process using a rolling or sizing unit.

DETAILED DESCRIPTION OF THE INVENTION

Figure 1:
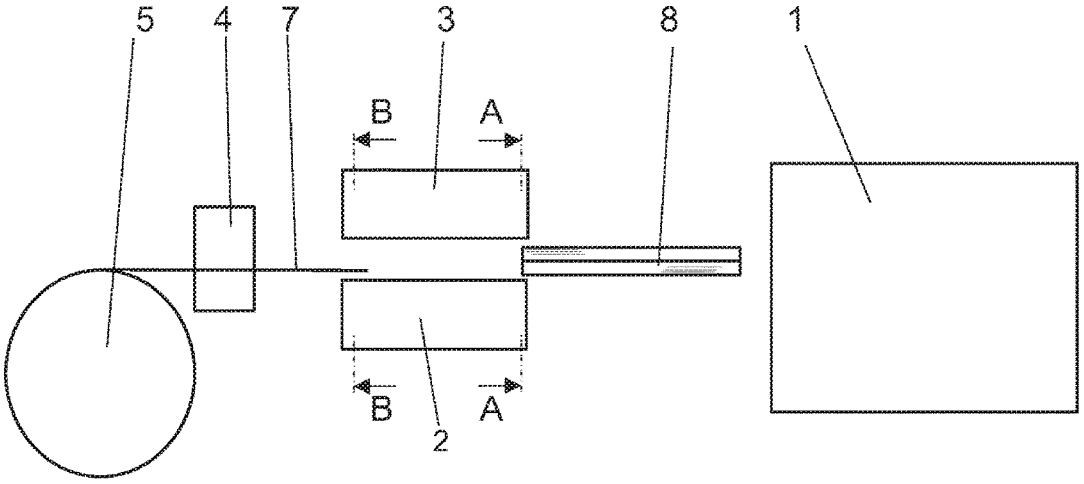
FIG. 1 shows a representative illustration of a system for producing strand-shaped profiles by way of an extrusion press which are subsequently formed to obtain a planar metal sheet.

The system is essentially composed of an extrusion press 1 for producing an extruded profile 8, a forming unit composed of a work coil 2 and a counter bearing 3, and a sizing unit 4.

Figure 2:
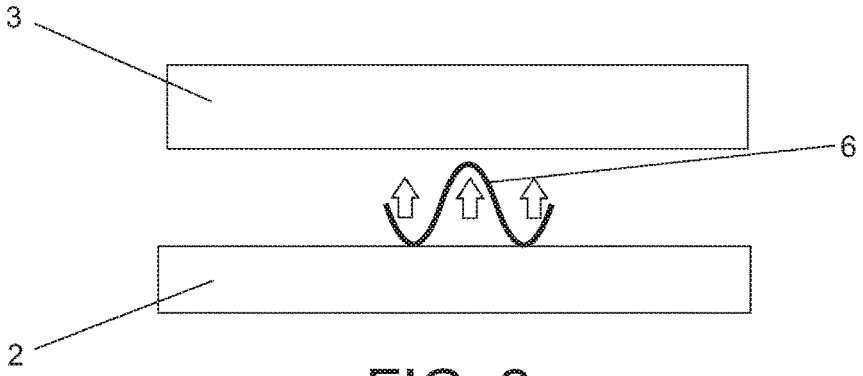
FIG. 2 is a cross-sectional view along line A-A in FIG. 1.
Figure 3:
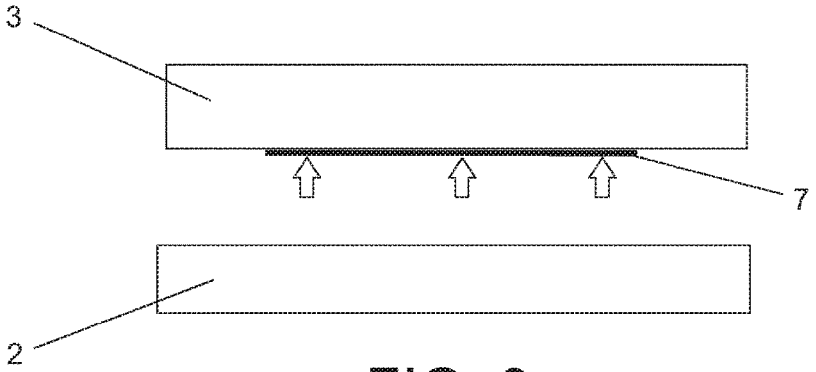
FIG. 3 is a cross-sectional view along line B-B in FIG. 2.

Using the extrusion press 1, a round billet is formed from a magnesium alloy to obtain an extruded "profile" 8, i.e., an elongated strand having a "profiled" widthwise cross-section, i.e., a cross-section which includes curvature, for example a profile 6 having three sinusoidal arcs in the cross-section. Thereafter, the profile 6 is positioned above the work coil 2 and formed under the action of a force of a pulsed magnetic field having very high intensity, wherein the profile 6 is formed against the counter bearing 3 to obtain a planar metal sheet 7. The force of the magnetic field acting on the profile 6 is illustrated in form of wide arrows in FIG. 2 and FIG. 3.

A magnetic field that changes over time induces eddy currents in the electrically conducting profile 8. The magnetic field exerts forces on these currents. The intensity of the forces is dependent on the spatial gradients of the magnetic flux density and the magnitude of the induced currents. The profile 8 is subjected to forces directed toward a lower flow density. The magnetic fields necessary for forming the profiles 8 to obtain planar metal sheets 7 are generated by discharging charged capacitors over the course of a few microseconds via a coil that is adapted to the profile geometry. This creates a very high magnetic pulse on the profile surface, as a result of which a current flows in the profile 8, which is directed against the coil current, wherein the profile 8 is moved in a predetermined direction toward lower fields i.e., against a planar surface of a body acting as a counter bearing, the planar surface being substantially orthogonal to the aforementioned predetermined direction.

The intensity of the induced currents and the attendant action of a force on the profile 8 depend on the electrical conductivity. Since magnesium or the magnesium alloy have relatively good electrical conductivity, high pressures act on the surface of the profile 8. These can amount to several thousand megapascals. This pressure only acts over a short time period, this being in the range of a few microseconds, for the duration of the discharge of the capacitors. During this time, the profile 6 takes up the required forming energy in the form of pulses. After an acceleration phase, the material of the profile 8 moves very quickly, due to the low mass thereof. It is possible for speeds of up to 300 m/s to be achieved. The stresses occurring in the profile 6 become so high that yielding occurs, within the meaning of metal forming technology, and the profile 6 is formed to obtain a planar metal sheet 7.

Afterwards the metal sheet 7 passes through a sizing unit for smoothing and is wound to form a coil 5. Alternatively, it is possible to replace the winding to form the coil 5, with a stamping or cutting unit, with the aid of which components are stamped from the metal sheet 7 coming from the sizing unit, or the metal sheet 7 is cut into panels or strips.

So as to form closed profiles 8 to obtain a metal sheet, these are either provided, by the configuration of the die, for example, with a predetermined breaking point along the peripheral surface line during production of the profile, or severed along the peripheral surface line using a cutting unit. Profiles 6 comprising an introduced predetermined breaking point are severed by the action of magnetic forces and formed to obtain a metal sheet 7.

Particular advantages of the method according to the invention are that the magnetic fields and the magnetic forces act unimpaired by the material, whereby the magnetoforming process can also be employed under vacuum or in a protective gas atmosphere, and additionally that magnetoforming systems do not require any mechanical contact with the workpiece, whereby surface contamination and tool impressions are avoided. The short process times for the forming operation to obtain the metal sheet 7 are also advantageous, being less than 0.1 s.

The invention claimed is:

1. A method for producing metal sheet of magnesium or a magnesium alloy, comprising:

extruding the magnesium or magnesium alloy through an extrusion die to form a strand, that is continuous and elongated, of the magnesium or magnesium alloy, the die being so configured that the strand as it exits the die has a widthwise cross-section of closed or open profile including curvature; and proximate the strand exiting the extrusion die, applying pulsed electromagnetic force to the strand from a magnetic field source spaced from the strand to shape the strand into a planar metal sheet by pushing the strand against a planar surface acting as a counter bearing.

2. The method for producing metal sheet according to claim 1, further comprising:

after said applying of electromagnetic force to obtain the planar metal sheet, smoothing the planar metal sheet by rolling or sizing; and winding the planar metal sheet into a coil.

3. The method for producing metal sheet according to claim 1, wherein the profile is open and comprises at least one sinusoidal contour.

4. The method for producing metal sheet according to claim 1, wherein the profile is closed and comprises a circle or approximately circular shape or includes at least one sinusoidal contour.

5. The method for producing metal sheet according to claim 1, wherein the profile is closed and as the magnesium or magnesium alloy is extruded to form the strand the strand is so formed as to facilitate breaking of the strand along a lengthwise line of the strand, the die being configured to form said lengthwise line on a peripheral surface of the strand.

6. The method for producing metal sheet according to claim 1, wherein the profile is closed and the method further comprises cutting the closed profile open along a line lengthwise of the strand.

7. The method for producing metal sheet according to claim 1, wherein the profile is closed and comprises a circle or approximately circular shape or includes at least one sinusoidal contour, further comprising:

cutting the closed profile open along a line lengthwise of the strand; and after said applying of electromagnetic force to obtain the planar metal sheet, smoothing the planar metal sheet by rolling or sizing.

8. The method for producing metal sheet according to claim 1, wherein the profile is closed and comprises a lengthwise line of the strand to facilitate breaking of the strand along thereof, the method further comprising severing the closed profile by action of magnetic forces along the lengthwise line.

9. The method for producing metal sheet according to claim 1, further comprising winding the planar metal sheet into a coil.

10. The method for producing metal sheet according to claim 1, wherein the step of applying electromagnetic forces to shape the strand into the planar metal sheet is performed in less than 0.1 sec.

11. The method for producing metal sheet according to claim 1, wherein the magnetic field source generates a magnetic field by discharging a charged capacitor.

12. A method for producing metal sheet of magnesium or a magnesium alloy, comprising:

extruding the magnesium or magnesium alloy through an extrusion die to form a strand, that is continuous and elongated, of the magnesium or magnesium alloy, the die being so configured that the strand as it exits the die has a widthwise cross-section of closed or open profile including curvature;

proximate the strand exiting the extrusion die, applying electromagnetic force to the strand from a magnetic field source spaced from the strand thereby to shape the strand into a metal sheet;

after said applying of electromagnetic force to obtain the metal sheet, smoothing the metal sheet; and winding the metal sheet into a coil.

13. The method as in claim 12, wherein smoothing the metal sheet is performed by rolling and sizing within a sizing unit.

14. The method as in claim 12, wherein the profile is closed and as the magnesium or magnesium alloy is extruded to form the strand, the strand is so formed as to facilitate breaking of the strand along a lengthwise line of the strand, the die being configured to form said lengthwise line on a peripheral surface of the strand, and wherein the closed profile is severed along said lengthwise line by the applied of magnetic forces.

15. The method for producing metal sheet according to claim 12, wherein the profile is closed and the method further comprises cutting the closed profile open along a line lengthwise of the strand.

16. An apparatus, comprising:

an extrusion press having a die profile configured to provide a strand of magnesium or magnesium alloy extruded therethrough with a cross-section which includes curvature;

a source of a magnetic field laterally spaced from the die and immediately downstream from where the extruded magnesium or magnesium alloy exits the die, the magnetic field source comprising an electric coil and the magnetic field source being configured to apply electromagnetic forces to the strand to force the strand to move in a predetermined lateral direction;

a body having a planar surface substantially orthogonally facing the direction in which the strand is forced to move and positioned to counter that movement whereby the surface is positioned and configured so that the electromagnetic forces applied by the magnetic field source push the strand against said planar surface thereby to flatten the strand into a sheet; and a rolling or sizing unit downstream of the magnetic field source and said body and configured to smooth a surface of the sheet, wherein the apparatus carries out the method according to claim 1.

* * * * *